US006158234A

United States Patent [19]

Szutu

[11] Patent Number: 6,158,234

[45] Date of Patent: Dec. 12, 2000

[54] SELF-COOLED REFRIGERANT RECOVERY SYSTEM

[76] Inventor: Hui Jen Szutu, 2451 Eastlake Ave., Los Angeles, Calif. 90031

[21] Appl. No.: 09/255,909

[22] Filed: Feb. 23, 1999

[51] Int. Cl.[7] ..... F25B 45/00

[52] U.S. Cl. ..... 62/292; 62/77

[58] Field of Search ..... 62/292, 77

[56] References Cited

U.S. PATENT DOCUMENTS 5,265,440 11/1993 Baker ..... 62/292
5,339,646 8/1994 Verlinden et al. ..... 62/292
5,375,425 12/1994 Cobb ..... 62/292
5,557,940 9/1996 Hendricks ..... 62/292
5,827,050 10/1998 Price ..... 62/292
5,893,995 4/1999 Waters ..... 62/292

*Primary Examiner*—William Doerrler
*Assistant Examiner*—Mark Shulman

[57] ABSTRACT

The refrigeration recovery system equips with a refrigerated container to cool the recovery tanks in order to have a desirable low pressure inside the recovery tank. This method is essential to accelerate the recovery speed and to achieve a complete recovery of refrigerants.

4 Claims, 1 Drawing Sheet

SELF-COOLED REFRIGERANT RECOVERY SYSTEM

BACKGROUND OF THE INVENTION

1. Field of the Invention

This invention relates to refrigerant recovery system, which is used for recovering gas and liquid refrigerants from air-conditioning and refrigeration systems, reclaiming used refrigerants into a recovery tank for recycling.

2. Description of the Prior Art

The HVACR industries had undergone a gigantic change since the phase out of ozone-depleting chlorofluorocarbon (CFC)-based refrigerants. In part of this U.S. clean air acts, we required to reclaim all refrigerants. Venting refrigerant into our air is no longer allowed. To comply with this earth shaking new law, a recovery system is needed for recovering refrigerants. Nevertheless, most technicians handling refrigerants are honestly complying with this new law. However, the sincere motivation to comply with the law is frequently failed due to the recovery systems often not doing it job well.

The recovery systems currently available in the industry have two common problems, the recovering speed is too slow and the pressure rapidly build up in the recovery tanks which is up to a dangerous level. The high pressure in the recovery tank not only slow down the recovery process, it also can be fatal as well to people whom close by if explosion ever occur. A pressure relief valve equipped in the tank can safeguard the tank in a safety pressure level by releasing refrigerant into the air when excessive pressure present inside the tank. It is legal to vent refrigerants into the air with this manner, but it is not good for our environment.

There are good chances that the refrigerant of an unit being recovered was partially recovered and the rest of the refrigerant remained in the unit was vented into our atmosphere, creating a long-term environmental problem. It is impossible to completely recover refrigerant if the recovery tank has excessive pressure. It slows down the recovery speed and the excessive pressure can burst the recovery tank as well. If this ever happens, the entire refrigerant in the recovery tank will be escaped out from the recovery tank.

Refrigerants can not be recovered into the recovery tank if pressure is too high inside the tank; even the tank is not full according to its capacity by weight. Nonetheless, all recovery system can easily handle refrigerants from small appliances such as home refrigerators, which contain small amount of refrigerants. To recover refrigerant from a small appliance, the pressure build up inside the recovery tank was not high enough to significantly block refrigerant flow into the recovery tank, if the recovery tank was at the room temperature at the beginning. But it is a different phenomena if a larger amount of refrigerant to be recovered. There will be fewer refrigerants recovered into the tank when the pressure differential decreases due to the pressure rapidly built up in the recovery tank. Sooner or later, there will be no refrigerant flowing into the recovery tank even the recovery pump keep running. Under this circumstance, the recovery pump can be burned since it works under intolerable high pressure.

The more powerful recovery pumps were install for some of the recovery systems attempted to overcome this high-pressure built up. Unfortunately, a bigger pump does not recover refrigerant much faster once the recovery tank pressure close to the pump discharged pressure. When the recovery tank pressure reach the pump discharge-pressure, there shall be no more refrigerants flow into the tank. Most likely, refrigerant will escape from the relief valve at this time. Otherwise, a more powerful recovery pump adds higher pressure into the recovery tank could be well beyond the safety level. This means a higher risk for people handling the recovery tank because of high internal tank pressure.

As the pressure increase, the heat also increases. The recovery tank can be exploded with the excessive pressure and heat built up in the tank. To avoid accident, high-pressure cutouts are installed for many recovery machines. During the high-pressure cutout, the recovery machine is not capable for operation. Some recovery system manufactures consider this problem with another approach by pre-cooling the refrigerant before it gets into the recovery tank by passing through a coil and cools it by fanning air through the coil. The high-pressure rapid built up in the recovery tank still an unsolved problem. Additionally, the cooling coil creates a very big problem by adding air into the recovery tank. The coil contents a large volume of air at the discharged side of the recovery pump. The air pocket in the cooling coil needs to be removed by another pump (almost never happen). Otherwise, the air was just pushed into the recovery tank mix with refrigerant. The refrigerant is contaminated with air and this is an explosive combination.

SUMMARY OF THE INVENTION

An object of the invention is to provide a recovery system would be able to maintain the recovery tank in low temperature and low pressure. Therefore, the pressure differential between the recovery tank and the discharge of the recovery pump remain high in the entire recovering process. Under this desirable high-pressure differential and the low pressure in the recovery tank, there will be a good flow of refrigerant recover to the recovery tank. This method can tremendously save our time to recover refrigerants into a recovery tank for recycling.

Another object of the invention is to provide a recovery system would be able to recover refrigerants completely without too much effort, minimizing the incomplete recovery of refrigerant due to the poor equipment being used. This method is essential to avoid the unrecovered refrigerant remains in the system and eventually vent into our air damaging our environment. The recovery system of the present invention is possible to completely recover refrigerant of a system in a brief time. There is no sweat complying with the refrigerants recovering guidelines established by the U.S. clean air acts.

A further object of the invention is to provide a safer working environment for people who recovering refrigerant into a recovery tank, the recovery tank pressure in the present invention remaining in the safety level. Otherwise, the accumulated high pressure of the recovery tank may become a very danger explosive device. If the recovery tanks ever explode or break, even in a small scale, the entire refrigerant in the recovery tank will be escaped from the tank and vented into our air. Personal injuries are most likely happened, if refrigerant sprayed on human bodies which can create severe burned. It could be fatal.

DESCRIPTION OF A PREFERRED EMBODIMENT

Figure 1:
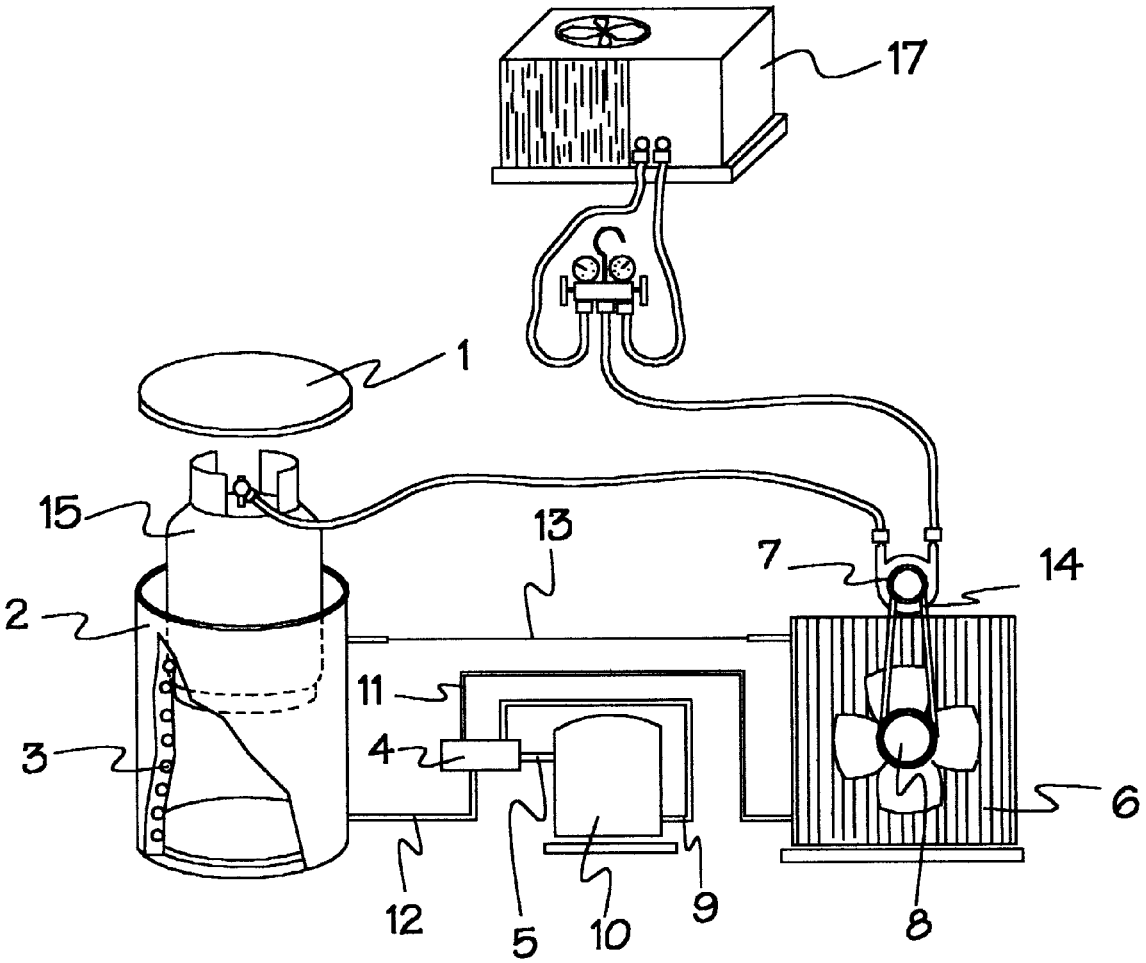
FIG. 1 is a perspective, partially sectional and schematic view of the invention.

Referring to the drawing, FIG. 1 shows a perspective view of the present invention. The recovery pump 7 recovers refrigerant into a recovery tank. It withdraws refrigerants out from a system being recovered and discharges refrigerants in high pressure. The high-pressure refrigerant flows into the recovery tank, and the pressure inside the recovery tank simultaneously builds up. The recovery tank is kept in the refrigerated container 2, with lid 1, to hold down its pressure by lower its temperature. The cylinder wall of this container has a spiral refrigeration coil 3, which is working together with the other refrigeration components, including compressor 10, condenser coil 6, condenser fan 8 and the expansion metering device 13. The compressor 10 removes heat out from the coil 3 in container 2 to the condenser coil 6. The condenser coil 6 ejects heat by the condenser fan 8 blowing hot air out from the condenser coil 6.

The pump 7 may work in different fashions. Typically, the pump 7 is belt 14 driven by the condenser fan motor 8, sharing a same electric motor for both condenser fan 8 and recovery pump 7. A separated motor with different power supply may also operate the recovery pump 7. For example, a temperature sensor from the inside of the refrigerated container 2 is controlling the operation of the recovery pump 7. With the temperature control, the pump 7 recovers refrigerants only if the recovery tank is cold enough corresponding to the desirable low pressure inside the recovery tank. Of course, the recovery pump can be independently operated as well; such as to let the recovery tank in the refrigerated container to get as cold as possible, then turn on and off the recovery pump as needed manually.

The reversing valve 4 will be able to alter the refrigerated container 2 from cooling mode to heating mode. In the cooling mode, the refrigerated container 2 is cold while the condenser coil 6 is hot, the reversing valve 4 inter-connects the compressor liquid line 9 to 11 and the compressor vapor line 5 to 12. On the other hand, for heating mode, the refrigerated container 2 is hot while the condenser coil 6 is cold, the reversing valve inter-changes the compressor liquid line 9 to 12 and the compressor vapor line 5 to 11. During the cooling mode, the refrigerated container 2 is cooling the recovery tank to lower the pressure inside the recovery tank and during the heating mode, the refrigerated container 2 is heating the recovery tank to raise the pressure inside the recovery tank.

Changing the cooling mode to the heating mode or vice versa actually is changing the refrigerant flows in the capillary tube 13. The capillary tube 13 is a bi-directional expansion valve. It meters the correct amount of refrigerant flow for both heating and cooling mode. During cooling mode, the refrigerant in the capillary tube 13 is flowing from coil 6 to coil 3 and during heating mode, the refrigerant in the capillary tube 13 reverses its flow from coil 3 to coil 6. The heating mode is being used for defrosting if the recovery tank was frozen in the refrigerated container 2, or the higher pressure is needed to withdraw refrigerant out from the recovery tank.

Water may be added into the refrigerated container (2) to stabilize the temperature of the container. If it is so desire, a recovery tank is mostly submerged into water but the valves on top of the recovery tank.

What is claimed is:

1. Apparatus for optimal transferring of refrigerant between a refrigeration system and a recovery tank, comprising:

an auxiliary refrigerating system including a container dimensioned to enable receiving the recovery tank therein which has its internal temperature selectively modified by said auxiliary system; and a selectively actuatable pump for moving refrigerant between the recovery tank and refrigeration system.

2. Apparatus as in claim 1, in which the auxiliary refrigeration system is selectively actuatable for heating or cooling the container.

3. Apparatus as in claim 1, in which the auxiliary refrigeration system is portable permitting use at the site of the refrigeration system.

4. A method of transferring refrigerant between a refrigeration system and a recovery tank, comprising the steps of:

interconnecting the system and recovery tank for refrigerant pumping therebetween;

adjusting the temperature of the recovery tank to a predetermined temperature condition for optimizing refrigerant pumping according to the relative actual refrigerant pressures existing respectively in the system and recovery tank; and pumping refrigerant between the tank and system.

* * * * *